US009833096B2

(12) United States Patent
Sorbin

(10) Patent No.: US 9,833,096 B2
(45) Date of Patent: Dec. 5, 2017

(54) CARPET STRETCHER

(71) Applicant: Sorbin Enterprises, Cleveland, OH (US)

(72) Inventor: Michael D. Sorbin, Garfield Heights, OH (US)

(73) Assignee: Sorbin Enterprises, Cleveland, OH (US)

( * ) Notice: Subject to any disclaimer, the term of this patent is extended or adjusted under 35 U.S.C. 154(b) by 182 days.

(21) Appl. No.: 14/639,445

(22) Filed: Mar. 5, 2015

(65) Prior Publication Data

US 2016/0255978 A1 Sep. 8, 2016

(51) Int. Cl.
*A47G 27/04* (2006.01)

(52) U.S. Cl.
CPC ..... *A47G 27/0493* (2013.01)

(58) Field of Classification Search
CPC ..... A47G 27/0493
See application file for complete search history.

(56) References Cited

U.S. PATENT DOCUMENTS 141,418 A * 8/1873 Boles ..... A47G 27/0493 254/212
574,122 A * 12/1896 Thompson ..... A47G 27/0493 157/1.38
1,685,689 A * 9/1928 Stewart ..... A47G 27/0493 38/102.1
2,606,743 A * 8/1952 Owens ..... A47G 27/0493 254/212
3,001,762 A * 9/1961 Skolnick ..... A47G 27/0493 254/212
3,216,702 A * 11/1965 Dahlke ..... A47G 27/0493 254/134
3,706,440 A * 12/1972 Ross ..... A47G 27/0493 254/212
3,752,440 A * 8/1973 Ream ..... A47G 27/0493 254/209
4,008,879 A * 2/1977 Youngman ..... A47G 27/0493 254/201
D327,002 S 6/1992 Breen
5,150,884 A * 9/1992 Hyer ..... A47G 27/0493 254/209
5,176,387 A * 1/1993 Taggart ..... A47G 27/0493 254/200
5,183,238 A * 2/1993 Sorensen ..... A47G 27/0493 254/200
5,269,576 A * 12/1993 Krebs ..... B60P 7/15 254/200
5,782,458 A * 7/1998 Prinzi ..... A47G 27/0493 254/209
5,855,361 A * 1/1999 Krowchak ..... B25B 25/00 254/209
D487,693 S 3/2004 Moen
(Continued)

*Primary Examiner* — William E Dondero
*Assistant Examiner* — Nathaniel L Adams
(74) *Attorney, Agent, or Firm* — Hahn Loeser & Parks LLP; Joel S. Sonnenberg

(57) ABSTRACT

A carpet stretcher, the tail assembly including a slider block, a first end and a second end attached to the slider block, wherein at least one of the first end and second end is moveable relative to the other of the ends on the slider block to define a gap having a selected width; and a locking assembly engagable with the at least one of the first end and second end to fix the selected width.

17 Claims, 19 Drawing Sheets

(56) References Cited

U.S. PATENT DOCUMENTS

| | | | | |
|---|---|---|---|---|
| 6,832,751 | B2 * | 12/2004 | Shannon | E04F 21/22 254/202 |
| D530,595 | S | 10/2006 | Lam et al. | |
| D699,231 | S | 2/2014 | Kim et al. | |
| D699,232 | S | 2/2014 | Jung et al. | |
| D699,713 | S | 2/2014 | Seong | |
| 8,757,595 | B2 * | 6/2014 | Garzanelli | A47G 27/0493 254/210 |
| D719,938 | S | 12/2014 | Kim et al. | |
| D723,358 | S | 3/2015 | Morris | |
| 2012/0117916 | A1 * | 5/2012 | Flores | A47G 27/0493 52/745.21 |

* cited by examiner

CARPET STRETCHER

TECHNICAL FIELD

In general, the present invention relates to a carpet stretcher. More particularly, the present invention relates to an end that is attached to an existing carpet stretcher or made part of a carpet stretcher to apply leveraging force to areas adjacent to a structure that is unsuitable for receiving such leverage. Most particularly, the present invention relates to a tail end that includes ends that extend axially and radially outward from the carpet stretcher to define a gap to receive a structure unsuitable for receiving the leveraging force and applying force through the ends to a suitable structure.

BACKGROUND OF THE INVENTION

Tufted carpet generally includes tufts of yarn stitched through a backing fabric and glued in place with an adhesive or bonding agent. The loops may be left in place in looped pile carpets such as Berbers, or cut to form a cut pile carpet. The backing is typically a plastic material such as polypropylene but other types of backing may be used. In some applications, a secondary backing such as a fabric or latex element is applied under the primary backing. In other applications, a padding layer or element may also be included, or a separate carpet pad may be laid on the floor before applying the carpet.

Installation of the carpet on the floor typically includes cutting a piece of carpet so that it overlaps the edge of the floor by a predetermined amount. Once the carpet is cut, positioned and any seams between adjoining carpet pieces sealed so that the carpet fills the desired space, the carpet is attached. Typically a knee kicker is used to attach the carpet along one edge. The knee kicker is a tool that includes a toothed end that engages the carpet. A padded portion of the tool is kicked by the installer toward the wall to stretch the carpet edge over a tacked strip that grabs the edge of the carpet and holds it in place. With one side of the carpet attached with the knee kicker, a carpet stretcher is used to attach the remaining edges of the carpet.

The carpet stretcher is similar to the knee kicker but much longer. A head of the carpet stretcher has teeth to grab the carpet and an activation lever to stretch the carpet over the tack strip. A tail end of the carpet stretcher extends away from the head and is placed against the wall where the carpet is attached. The tail end engages a supporting structure so that activation of a lever arm on the head of the carpet stretcher applies a force against the structure via the tail end while forcing the head away from the tail to stretch a free end of the carpet over a tack strip.

SUMMARY OF THE INVENTION

The present invention generally provides a tail assembly in a carpet stretcher, the tail assembly including a slider block, a first end and a second end attached to the slider block, wherein at least one of the first end and second end is moveable relative to the other of the ends on the slider block to define a gap having a selected width; and a locking assembly engagable with the at least one of the first end and second end to fix the selected width.

The present invention further provides a carpet stretcher including a head assembly having a carpet engaging surface, a mounting assembly attached to the head assembly, the mounting assembly includes a tensioner mount and an extension mount; a tensioner attached to the tensioner mount, the tensioner including a tension handle that pivots on the tensioner mount; an extension member, the extension member having a first end and a second end, where the first end is attached to the head assembly at the extension mount; a tail assembly attached to the extension member opposite the head assembly, the tail assembly including a slide block pivotably attached to the extension member at the second end, a first arm and a second arm attached to the slide block and extending radially outward from the slide block, wherein at least one of the first and second arms is slideably attached to the slide block; each of the first arm and second arm having an end that extends axially outward therefrom to define a gap therebetween, wherein the gap is adjustable by sliding at least one of the first and second arms relative to the slide block; and a locking assembly engagable with the at least one of the first arm and second arm to fix the gap between the ends.

The following description and the annexed drawings set forth in detail certain illustrative aspects of the claimed subject matter. These aspects are indicative, however, of but a few of the various ways in which the principles of the innovation may be employed and the claimed subject matter is intended to include all such aspects and their equivalents. Other advantages and novel features of the claimed subject matter will become apparent from the following detailed description of the innovation when considered in conjunction with the drawings.

DETAILED DESCRIPTION OF THE INVENTION

As used herein, spatially orienting terms such as "above," "below," "upper," "lower," "inner," "outer," "right," "left," "vertical," "horizontal," "top," "bottom," "upward," "downward," "laterally," "upstanding," et cetera, can refer to respective positions of aspects as shown in or according to the orientation of the accompanying drawings. "Inward" is intended to be a direction generally toward the center of an object from a point remote to the object, and "outward" is intended to be a direction generally away from an internal point in the object toward a point remote to the object. Such terms are employed for purposes of clarity in describing the drawings, and should not be construed as exclusive, exhaustive, or otherwise limiting with regard to position, orientation, perspective, configuration, and so forth.

Figure 10:
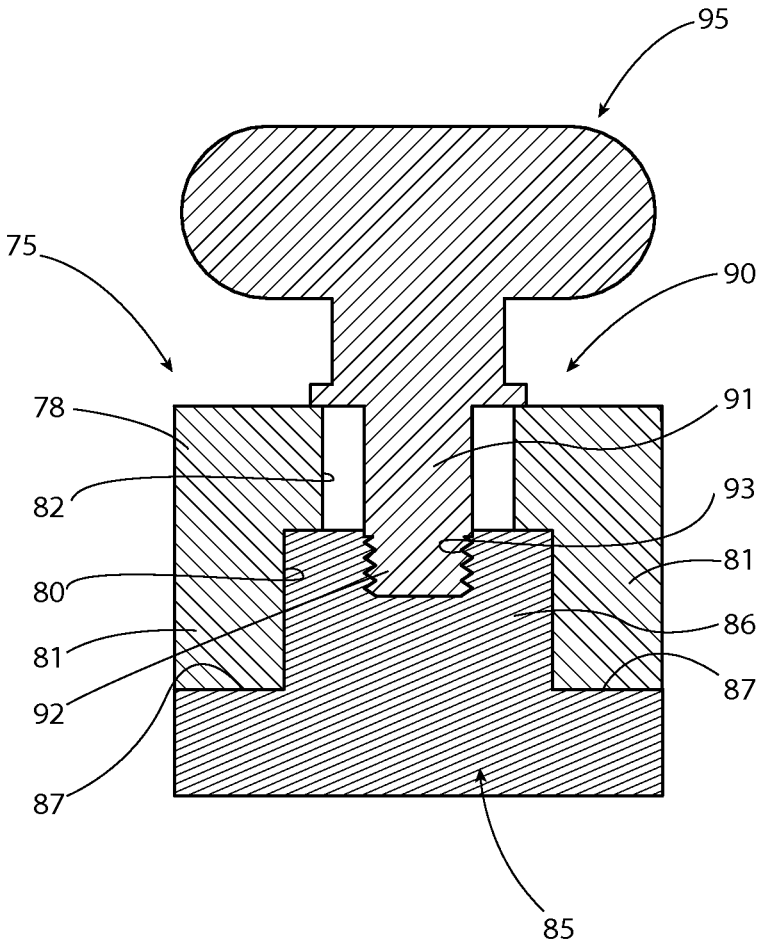
FIG. 10 is a section view as might be seen along line 10-10 in FIG. 3.

A carpet stretcher according to one embodiment is generally indicated by the number 10 in the drawings. Carpet stretcher 10 and the components thereof may be made of various materials including but not limited to metals, metal alloys, plastic, wood, fiber reinforced composites, polymer based materials, rubber and combinations thereof. With reference to FIG. 10, carpet stretcher 10 generally includes a head assembly 20, an extension 30, and a tail assembly 50.

The head assembly 20 is used to stretch an end $C_{end}$ of carpet C over a tack strip T to attach the carpet C to a floor and ensure that it has a clean wrinkle free appearance. In general, the head assembly 20 is connected to the extension 30 and tail assembly 50. The tail assembly 50 is placed at an end of the carpet that has been attached to a tack strip T by a knee kicker or other device. The extension 30 connects tail assembly to head assembly 20. The length of extension 30 may be adjusted to accommodate the size of the carpet C. To that end, extension 30 may include multiple members that are attached to each other or extendable members, such as a tube within tube construction that may be telescoped relative to each other and locked at a selected length.

Figure 11:
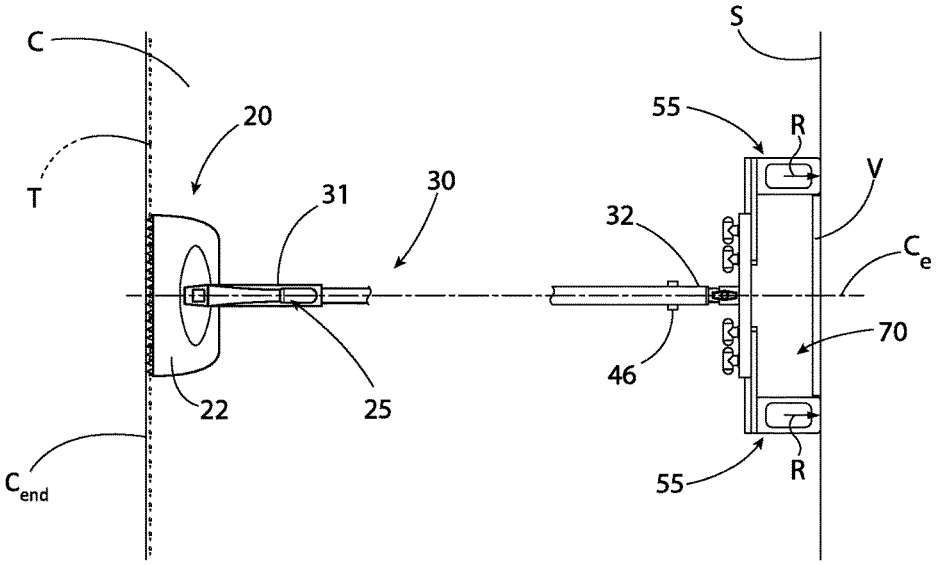
FIG. 11 is a somewhat schematic top view showing use of a carpet stretcher according to the invention.
Figure 12:
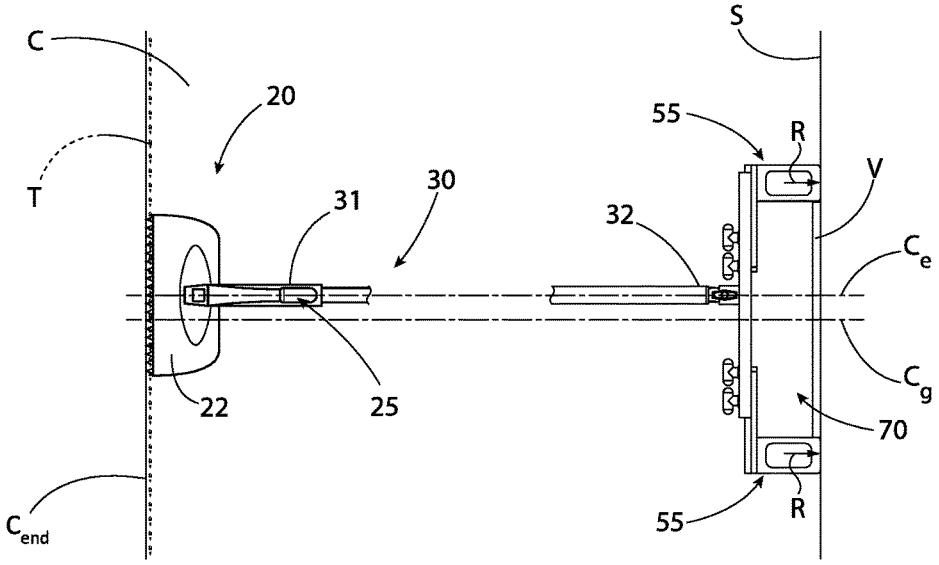
FIG. 12 is a top view similar to FIG. 7 showing the ends of the tail assembly positioned to create an offset gap relative to the center of the extension.
Figure 15:
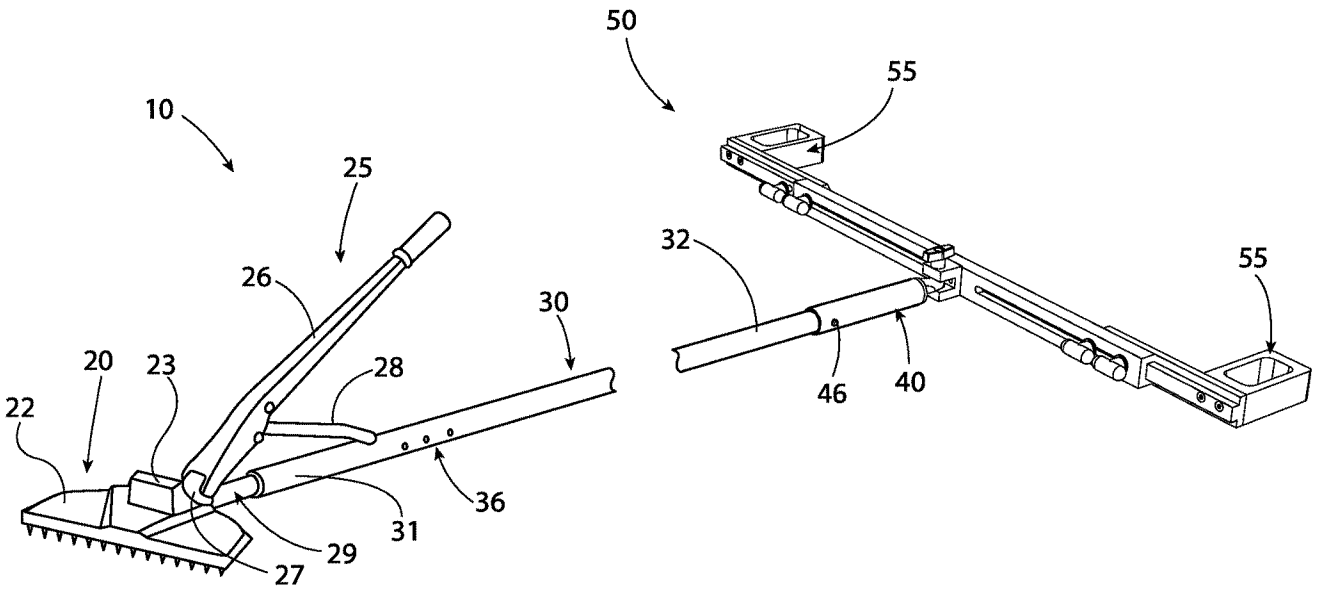
FIG. 15 is a partially fragmented perspective view of an embodiment including a head assembly and extension attached to a tail assembly.
Figure 16:
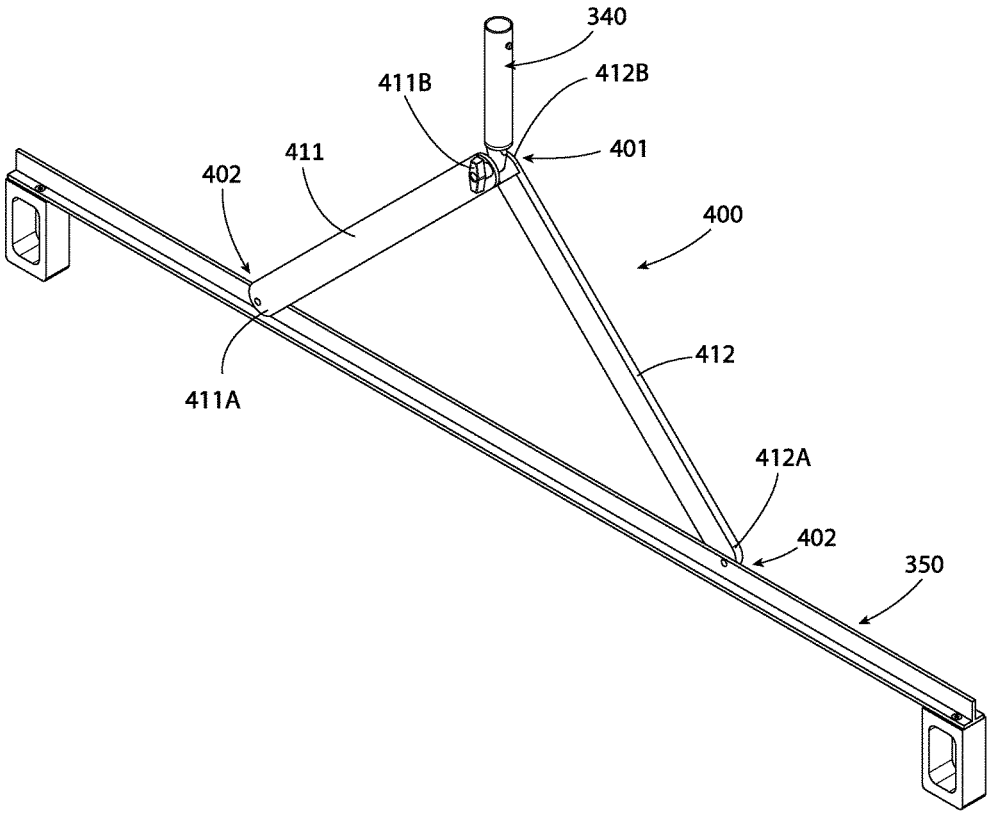
FIG. 16 is a top perspective view of another alternative embodiment.
Figure 17:
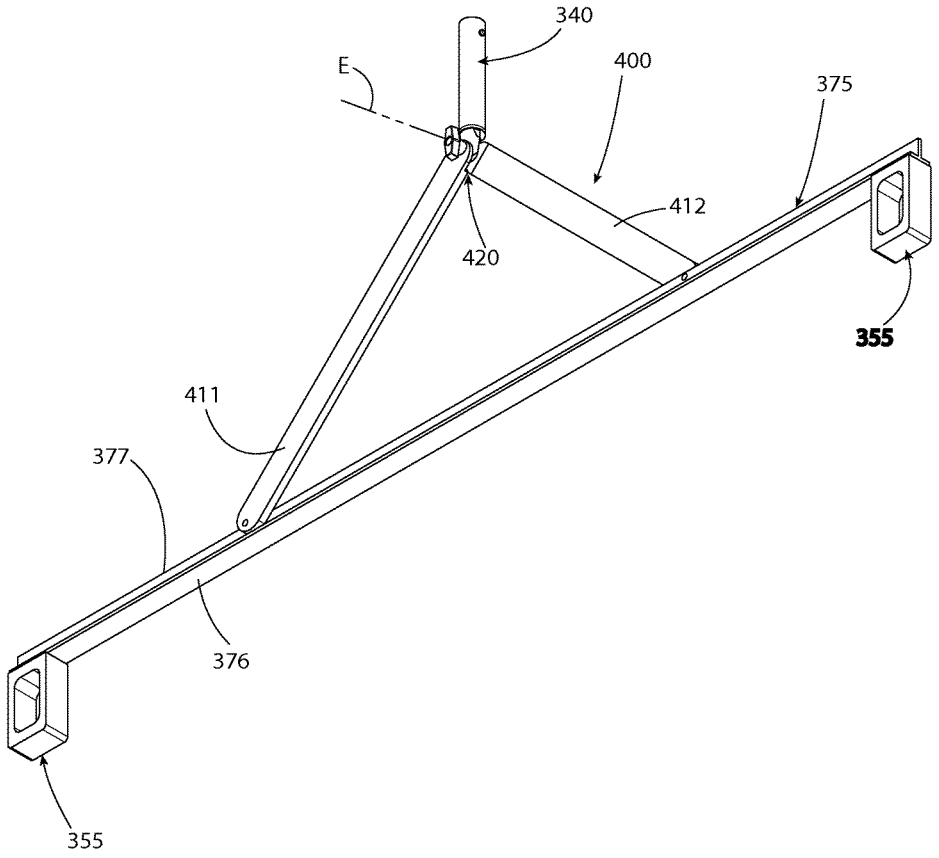
FIG. 17 is a bottom perspective view thereof.
Figure 18:
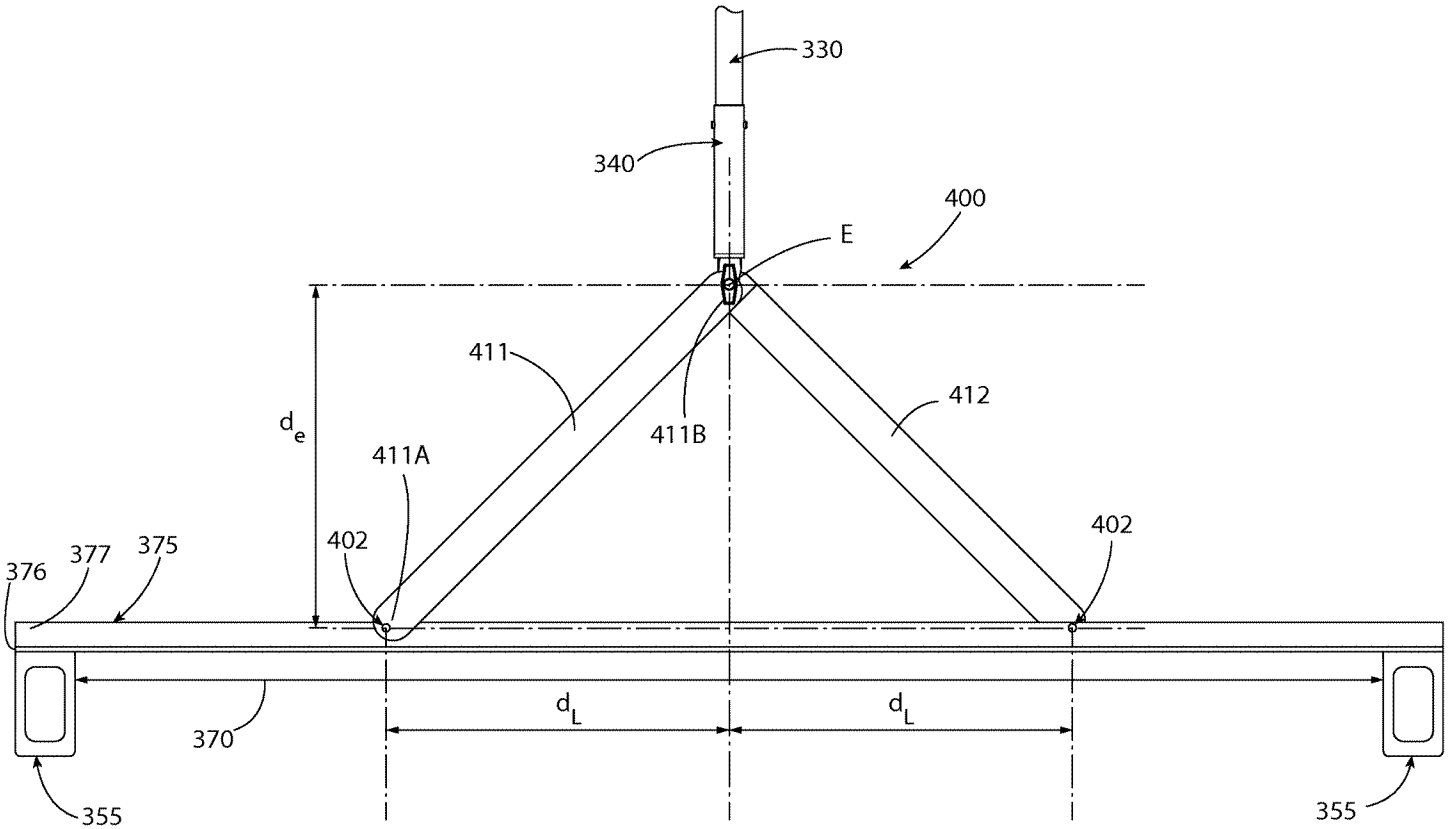
FIG. 18 is a partially fragmented side view thereof with a portion of an extension shown.
Figure 19:
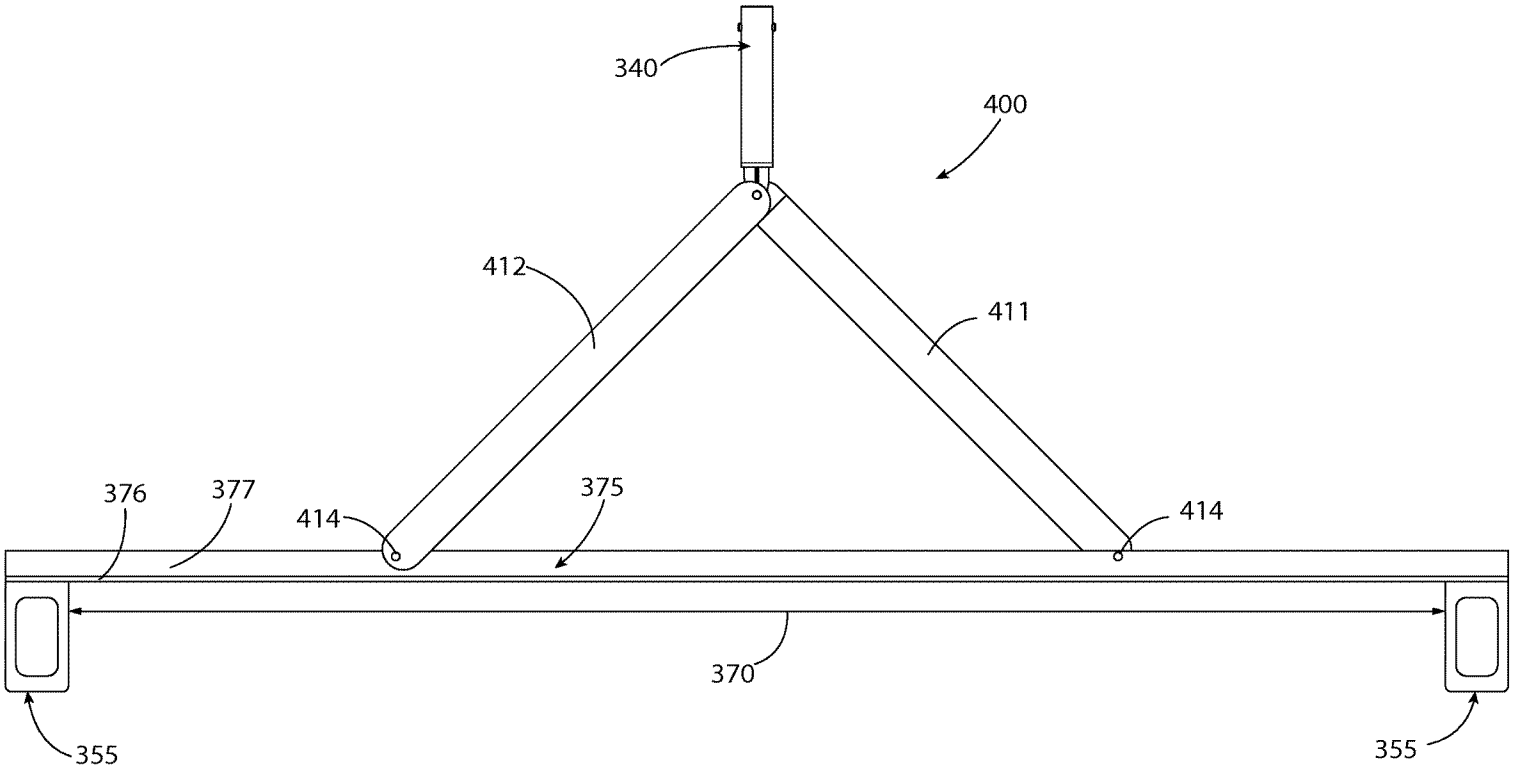
FIG. 19 is a side view similar to FIG. 18 with the extension removed.

With reference to FIGS. 11, 12 and 15, the head assembly 20 is placed at a free end of the carpet C to stretch that end away from the tail assembly and attach the free end to the tack strip. Head assembly 20 includes a head 22 that engages the carpet C and may include teeth, a higher friction surface, or other members used to grip the carpet C. A head handle 23 may optionally be included to assist the user in placing the head 22. As shown, handle 23 may extend upward from a top surface of head 22 a sufficient extent to clear other structures on head 22. Head assembly 20 further includes a handle assembly 25 that couples the head 22 and extension 30 and moves the head 22 relative to a first end 31 of extension 30 to stretch the carpet C. For example, handle assembly 25 may include a handle 26 pivotally attached to head 22. Pivotal attachment may be of any suitable form including but not limited to a boss 27 that extends upward from head 22 with the handle 26 pivotally attached to boss 27. For example, a pin or other suitable structure may extending through boss 27 and engage handle 26. Handle 26 is attached to extension 30 by a linkage 28 that is pivotally attached at each end. Handle 26 extends upward and inward relative to head 22 and may be driven downward to apply a force to drive head 22 away from extension 30. To that end, head 22 may be mounted on a telescoping assembly 29 supported on the first end 31 of extension 30.

A second end 32 of extension 30 is located distally from head assembly 20. As mentioned, the length of extension may be adjusted by extending or retracting a portion of extension, such as a telescoping arrangement, or by attaching or removing extension sections. A detent assembly 36 may be used to attach adjacent sections as shown, including attaching or removing extension sections.

Second end 32 of extension 30 may include a swivel mount, generally indicated at 40, to pivotally mount tail assembly 50 to extension 30. Swivel mount 40 may include a tongue 41 having an opening defining a swivel axis 42 that is perpendicular to the extension axis. It will be understood that swivel mount 40 may provide additional degrees of freedom as needed, for example, through use of a universal joint or the like. In the example shown, rotation about swivel axis 42 is perpendicular to extension 30 to allow rotation of tail assembly 50 about this axis and to permit tilting of the major axis 52 of tail assembly 50 relative to extension 30. Swivel axis 42 may be defined by any suitable structure including a bearing assembly, pin, or bolt 43 as shown. Bolt 43 may include a handle to facilitate interchanging tail assemblies.

Tail assembly 50 may be tilted on swivel axis 42 to align the tail assembly 50 with walls or other structures against which the tail assembly 50 may bear during the stretching process. Swivel mount 40 may include a tubular receiver that receives second end 32 of extension 30 and attach it to tail assembly 50. To facilitate attachment, a detent or similar device may be provided within the bore 45 of a tubular receiver to interact with the end 32 of extension 30. In the example shown, detents 46 extend through openings on each side of a tubular receiver to engage openings on extension 30. A biasing element such as a leaf spring 47 is provided within the bore 45 between detents 46 to bias the detents outward. In the example shown, a tubular receiver is sized to fit within the bore of extension 30. It will be understood that tail assembly 50 may be attached directly to extension 30 without the intervening swivel mount 40.

Tail assembly 50 includes one or more ends, generally indicated by the number 55, that extend outward to contact a supporting surface S such as a wall or the like within a room where the carpet C is being laid. Ends 55 may have any shape or configuration suitable for providing this contact including but not limited flat surfaces to spread contact across a larger area, or column or other point contact shapes or combinations thereof. Referring back to FIGS. 11 and 12, operation of handle assembly 25 creates reaction forces R at ends 55 that are applied to structure S without applying force to the obstruction received within gap 70 between ends 55. In this way, a stable platform for extension of telescoping assembly 29 and stretching of carpet C is provided.

Figure 1:
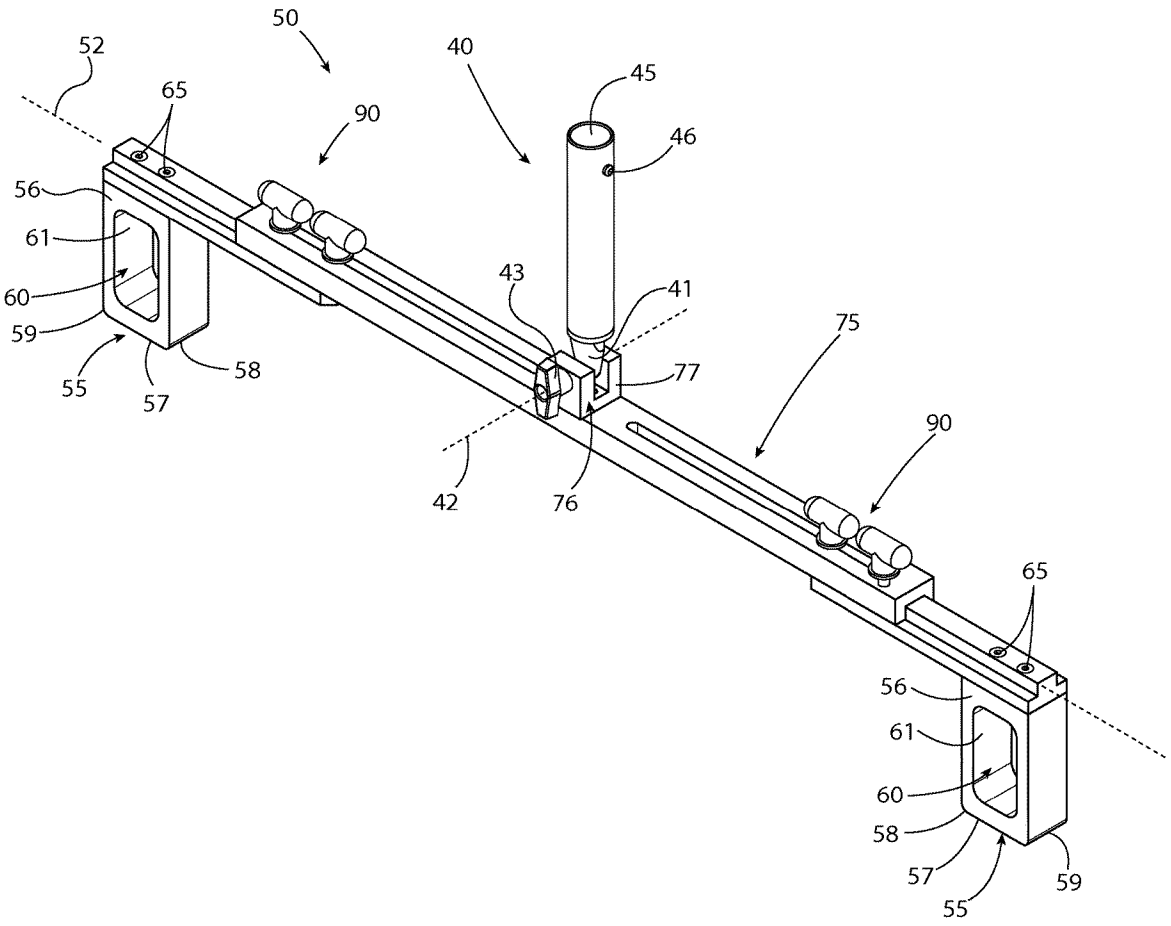
FIG. 1 is a top perspective view of a tail assembly in a carpet stretcher according to the invention.
Figure 2:
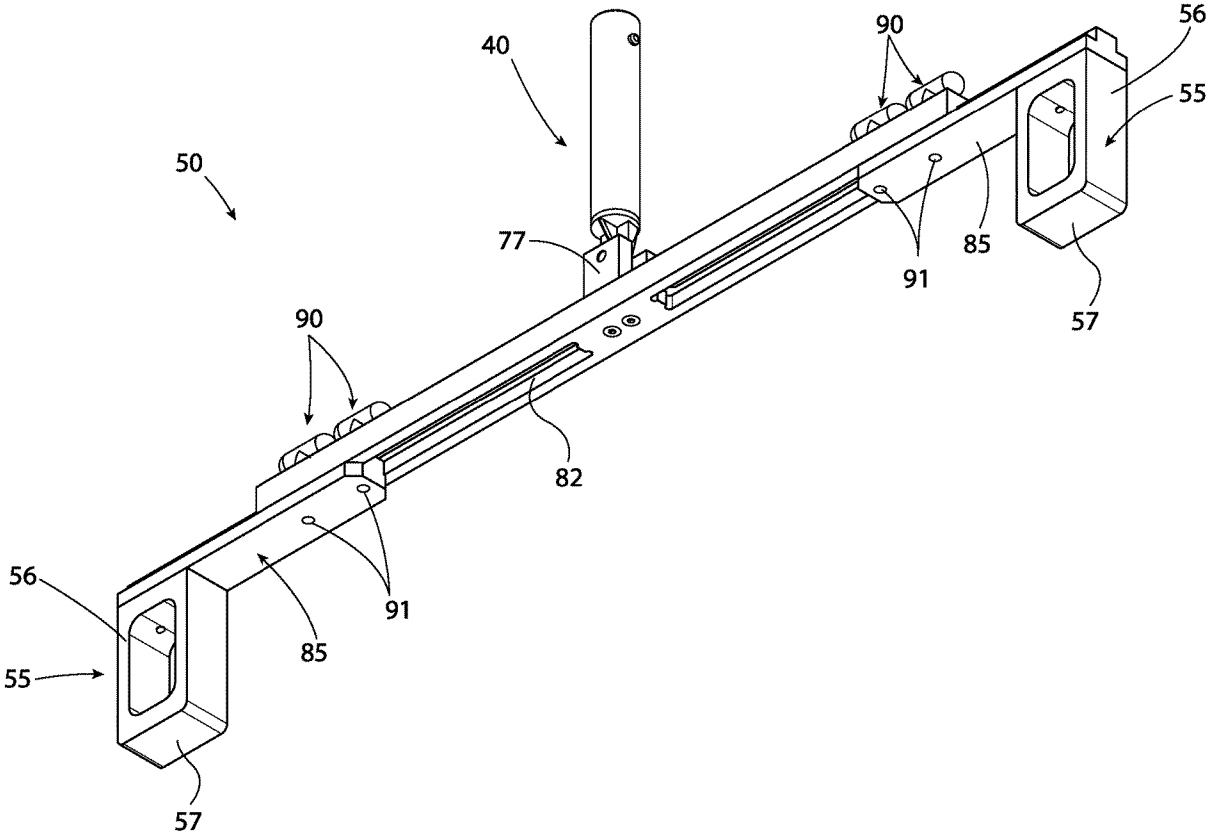
FIG. 2 is a bottom perspective view thereof.
Figure 3:
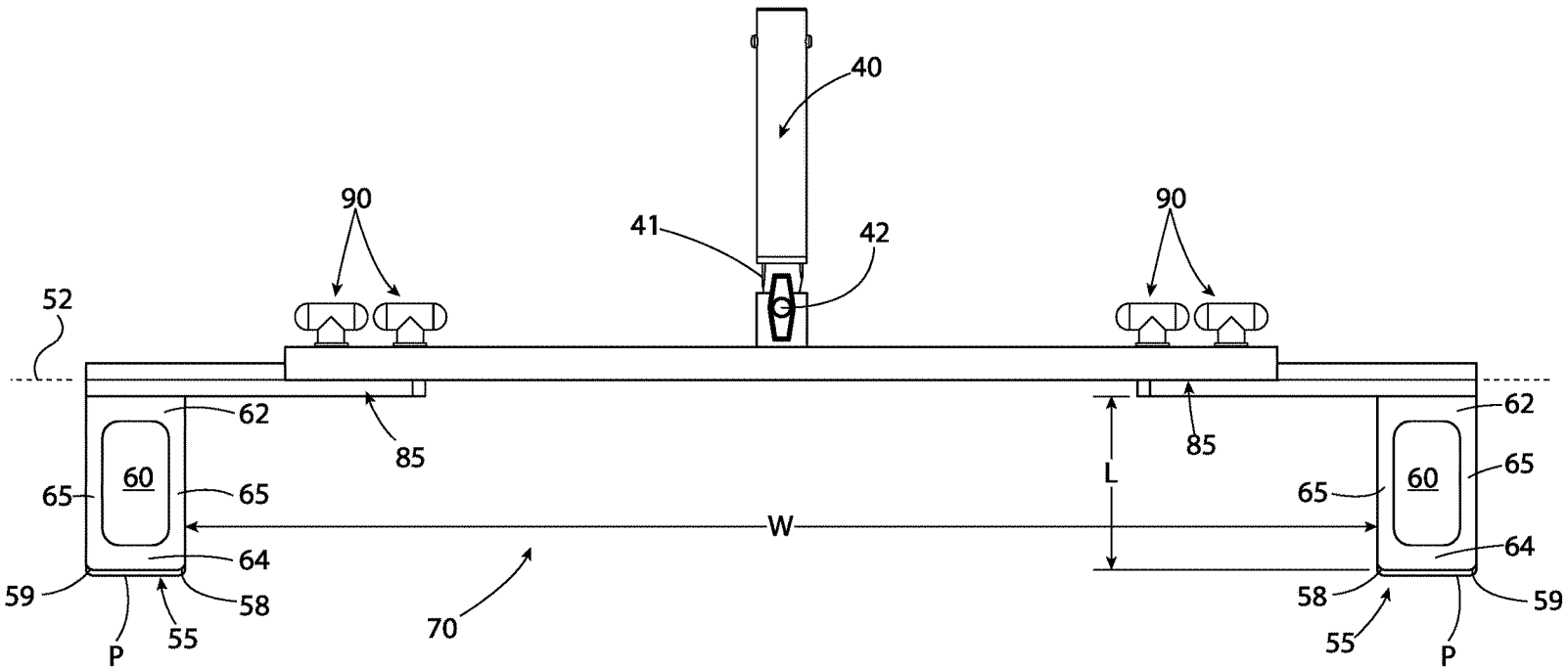
FIG. 3 is a front view thereof.
Figure 4:
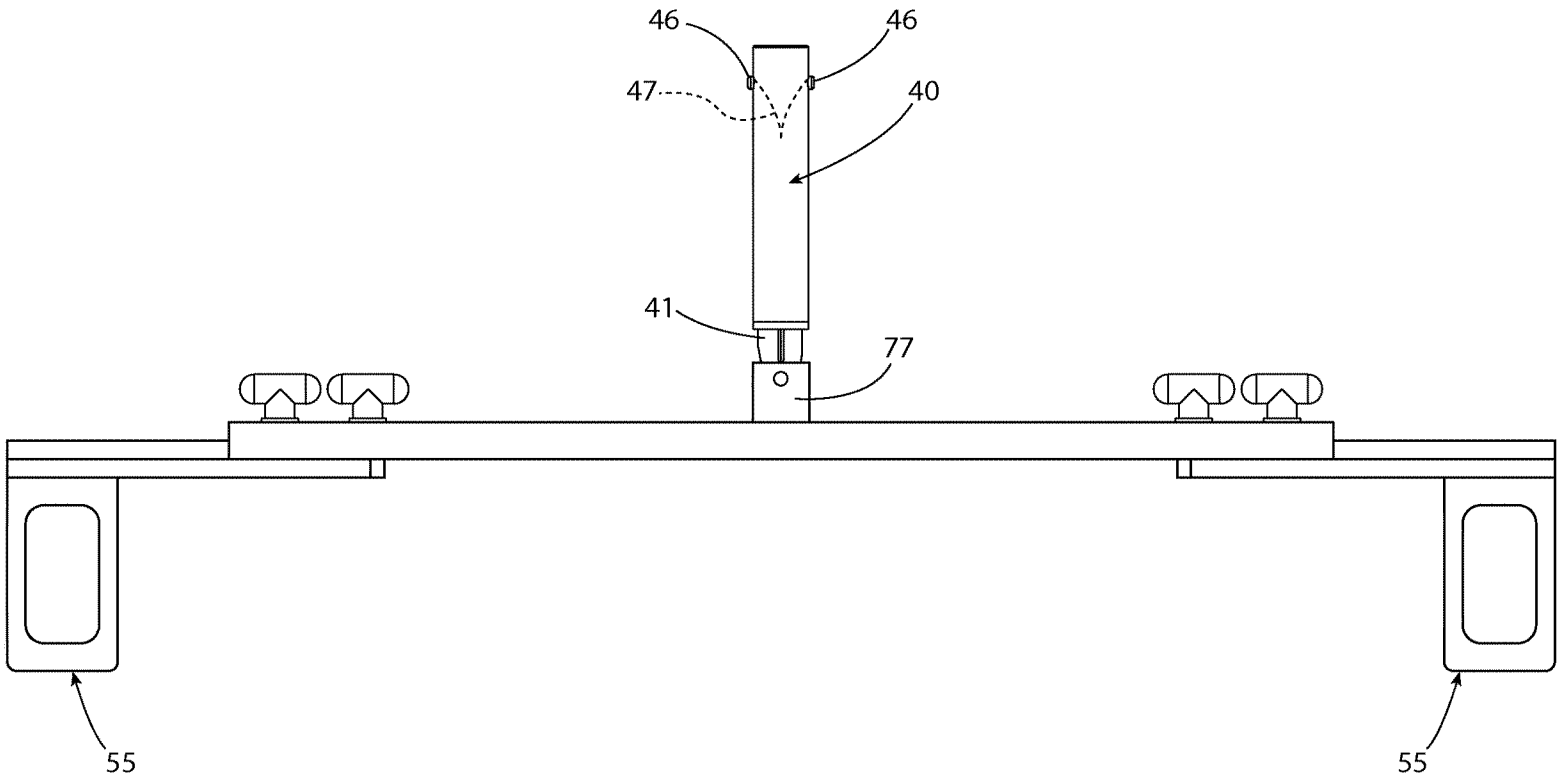
FIG. 4 is a rear view thereof.
Figure 5:
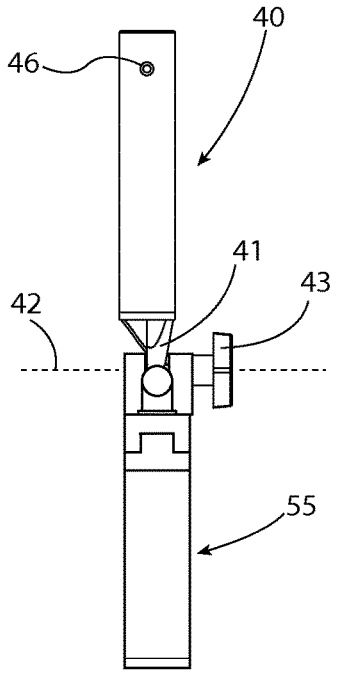
FIG. 5 is a left side view thereof.
Figure 6:
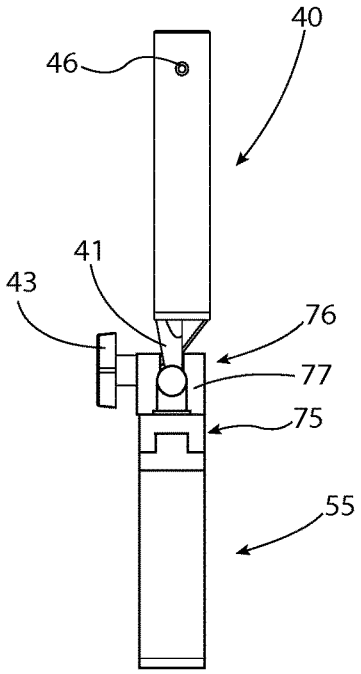
FIG. 6 is a right side view thereof.
Figure 7:
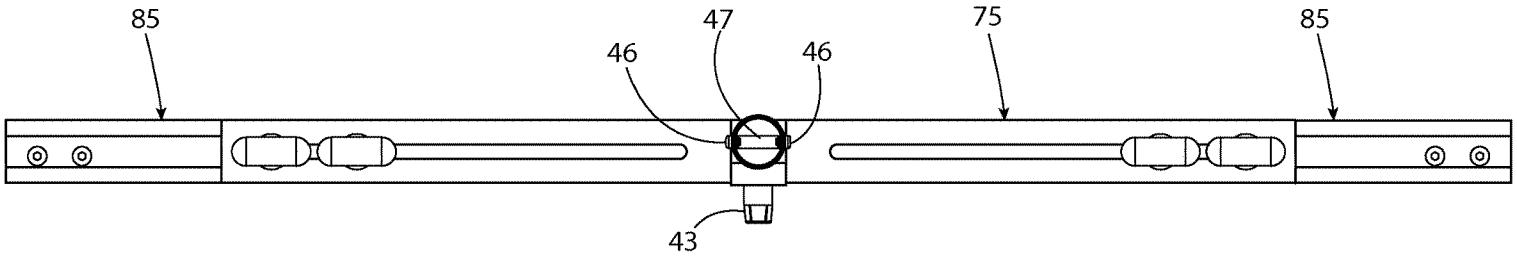
FIG. 7 is a top view thereof.
Figure 8:
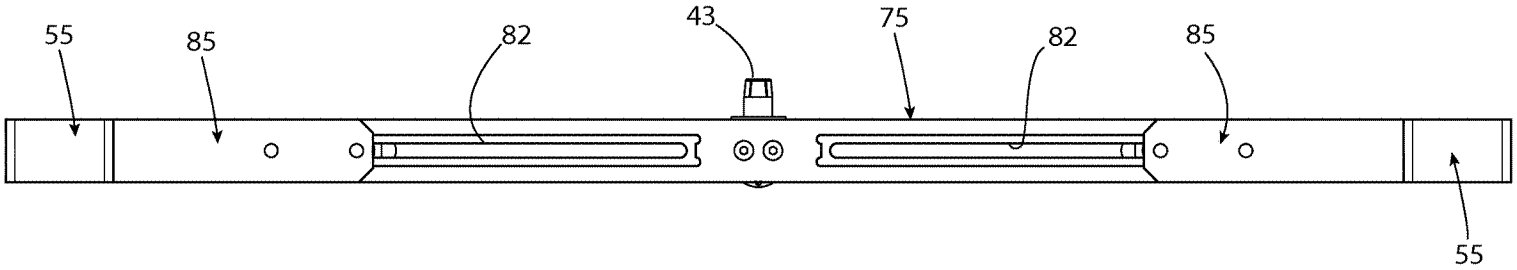
FIG. 8 is a bottom view thereof.
Figure 9:
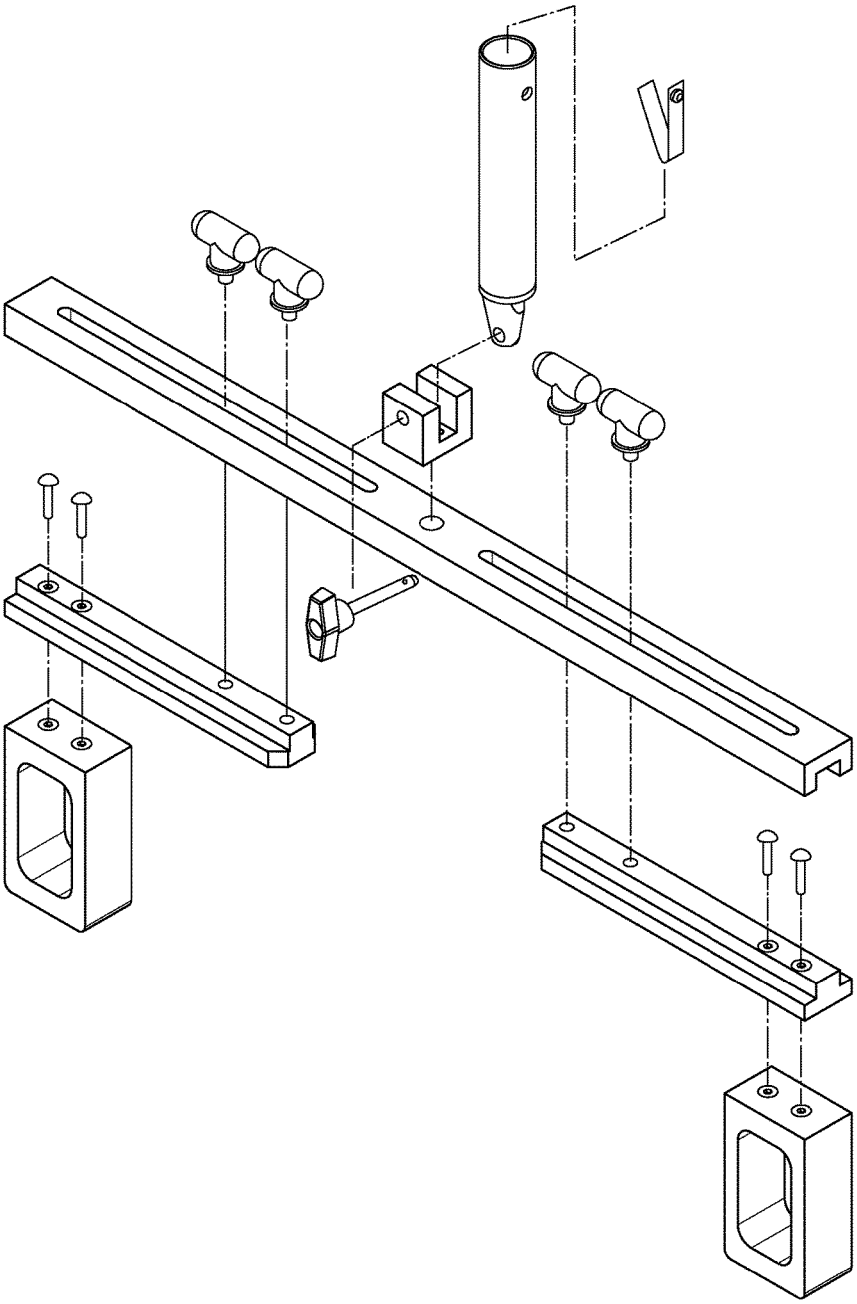
FIG. 9 is an exploded perspective view thereof.

In the example shown in FIG. 1, ends 55 include block-like standoffs 56 that have an outer surface 57 that is rectangular in shape (FIG. 2). The inner edge 58 and outer edge 59 of outer surface 57 may be rounded to minimize the chance of a sharp edge damaging or marring the wall against which they bear. Optionally, as shown in FIG. 3, pads P may be attached to ends 55 to reduce wear and tear on the supporting structure and/or the ends themselves or provide grip. Pads may be constructed of any suitable material including but not limited to paper products, cardboard, rubber, silicone, polymer materials, foam materials, or other cushioning elements. To reduce the weight of tail assembly 50, ends 55 may define a hollow 60. Hollow 60 may be a recess within the end to remove material or a through hole 61 as shown. With reference to FIG. 3, each standoff 56 may include a top wall 62 and a bottom wall 64 spaced axially by a pair of sidewalls 65 to define a generally rectangular hollow 60.

In one configuration, ends 55 are spaced from each other to define a gap 70 to accommodate structures on the floor, wall or other structure within the room. In particular, such structures may not be suitable points for the tail assembly 50 to bear upon or may be damaged if used as a bearing point. For example, it may be desirable to move the contact points of tail assembly 50 to avoid contact with floor vents, wall vents, steps, doorways and the like. A wall vent V is used as one example of such a structure in FIGS. 11 and 12. The ends 55 may be spaced to provide a fixed gap 70 to receive these structures within gap 70 such that the ends 55 contact points outward of such structures. Gap 70 may have a center axis or gap center Cg that is aligned with the center axis of extension 30 referred to as an extension center Ce herein (FIG. 11), or gap center Cg may be offset from extension center Ce (FIG. 12). Optionally, as shown, a width W of gap 70 may be adjusted by moving ends 55 relative to each other to close or open gap 70. As depicted in FIGS. 11 and 12 and described in more detail below, ends 55 may move independently to allow gap 70 to be longer on one side than another relative to the extension center Ce. This allows the user to offset gap 70 relative to extension center Ce when the obstruction is not centered with extension 30 (FIG. 12).

Movement of ends 55 may be effected by any suitable assembly including a rotating mount that rotates the ends from an inward position to an outward position, or to provide a wider range of adjustment, ends may be slidably attached to a bracket or other member which in turn is attached to extension 30. With reference to FIG. 1, one embodiment of tail assembly includes a slider block, generally indicated by the number 75. Slider block 75 is attached to an end of extension 30 and generally is a member on which ends 55 are supported in the desired relationship. As discussed ends 55 may be spaced from each other by a preset amount or may move relative to each other to adjust the width of a gap 70. Ends 55 may be formed integrally with slider block 75 or attached to slider block 75 in any known manner. As mentioned, slider block 75 attaches to extension 35 such that force from head assembly 20 is transmitted to tail assembly 50 via extension 30 for purposes of stretching the carpet. Attachment of slider block 75 to extension 30 may be direct or through a mount 40.

Mount 40 may be attached to slider block 75. To facilitate attachment, slider block 75 may include a mounting portion 76. Mounting portion 76 may be integrally formed with slider block or attached to slider block 75 as shown. Mounting portion 76 may be any member that attaches slider block 75 to extension 30 or to a mount 40 used to receive an end of extension. This member may include a bracket, plate, or clevis 77 as shown. Clevis 77 has openings corresponding to the opening in tongue 41 of swivel mount 40. Bolt 43 may be passed through all of the openings and secured with a nut on a far side of clevis 77, or as shown, one end of clevis 77 may be threaded to receive the threaded end of bolt 43.

Slider block 75 defines an outward opening channel 80 between a pair of downwardly extending rails 81. Channel 80 extends the full length of slide bar 78 but it may be divided at the center and closed at the ends to limit the range of motion for ends 55. Slider block 75 may further define a slot 82 that opens into channel 80 and extends through the inward surface of slide bar 78. Ends 55 may attach directly to slider block, or as shown, in the FIGS. 1-12 ends may attach to an intermediate member that is supported on slider block 75. Ends 55 may be attached to this intermediate member by one or more end fasteners 65. In the example shown, two fasteners 65 are provided to prevent inadvertent rotation of the end 55.

With reference to FIG. 1, an arm, generally indicated by the number 85, is provided to slide within channel 80 and provide a structure to which the end 55 is attached. To that end, a first arm 85 may support first end 55 and second arm 85 may support second end 55. Each arm 85 includes a base 86 with a riser 87 that extends upward therefrom and is sized to be slidably received within channel 80. In the example shown, riser 87 is centered on base forming pair of shoulders adjacent to riser 87 that extend outward from riser 87 and abut rails 81. A flat outer surface is provided to facilitate mounting of end 55 to arm 85. In the example shown, fasteners 65 are used to attach ends 55 to each arm 85. It will be understood that outer surface may be contoured as well.

Arms 85 are made to slide on slider block 75 to adjust the position of ends 55 attached thereto. The selected position between ends 55 may be held with a locking assembly, generally indicated at 90. In the example shown, locking assembly 90 includes fasteners that also attach mounting block 85 to slider block 75. Fasteners 91 may extend through slot 82 and into arm 75. With reference to FIG. 10, an end 92 of fastener 91 attaches to mounting block 85. Fastener 91 may attach to arm in any known manner including pinning, clamping, a nut or a threaded receiver 93, as shown. In the example shown, end 92 of shaft has a thread corresponding to an internal thread in receiver 93. Locking assembly 90 may include a handle assembly, generally indicated at 95 that is attached to fastener 91. Handle assembly 95 includes a portion that is wider than slot 82 such that mounting block 85 hangs from slider block 75. The handle assembly 95 is rotated to draw arm 85 upward into channel 80 clamping the arm 85 to fix the position of at least one end 55. In the example shown, each arm 85 is slidable and locking assemblies 90 are provided on each arm so that each arm may be separately moved and fixed in a selected position to define the gap 70.

Locking assembly 90 may include multiple fasteners 91 may be used to reduce twist and facilitate adjustment of the position of ends 55. As best shown in FIG. 1, two fasteners 91 are provided to attach each mounting block 85 to slider block 75.

With reference to the embodiment shown in FIGS. 1-12, arms 85 are provided on slider block 75. The arms 85 are slidably attached to slider block 75 and in turn ends 55 are attached to respective arms 85. It will be understood that arms 85 may be omitted and the ends 55 slidably attached to the slider block 75.

Figure 13:
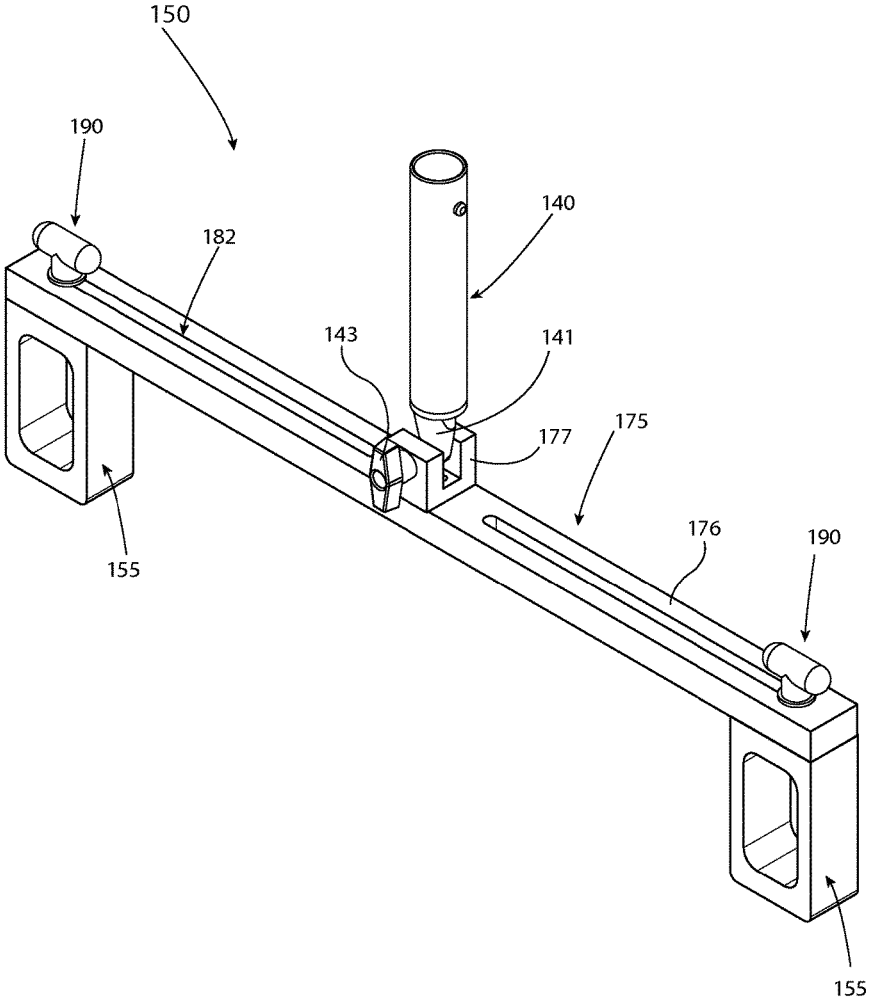
FIG. 13 is a perspective view of an alternative embodiment.

One example of such an embodiment is shown in FIG. 13. The like numbers have been used to refer to similar components, and components may be interchanged between embodiments. In FIG. 13, a tail assembly, generally indicated by the number 150, includes a pair of ends 155 slideably attached to a slider block 175. Arms are integral to slider block 175. Ends 155 may be slidably attached in any known manner. In the example shown, slider block 175 defines a slot 182 that receives a fastener, such as a pin, rod, bolt, or the like, that is sized to slide within the slot 182. Fastener 190 includes a handle located inward of slot 182 and a shaft that extends through slot 182 and is secured within end 155, as discussed in the previous embodiment with respect to mounting block. Also, as described in that embodiment, the fastener 190 may be loosened to allow the end 155 to slide within slot 182 and tightened to set the end in a desired position. Both ends 155 may be so adjusted to define a selected gap therebetween.

Slider block 175 may include linear member 176 supported on an end of extension 30 as described in the previous embodiment. For example, as shown, member 176 may include a clevis 177 to pivotally attach slider block 175 to an extension receiver 140. As in the earlier embodiment, attachment of clevis 177 to extension receiver 140 may include a tongue 141 that extends from receiver 140 into clevis 177 and a fastener 143 that passes through both the clevis 177 and tongue 141. This fastener 143 may include a handle to facilitate application of a clamping force through fastener 143 to fix the position of slider block 175 relative to receiver 140 and in turn extension 30. It will be understood that the attachment shown is not limiting as a fixed position attachment, such as a weld or integral extension receiver is suitable. Or attachments providing greater degrees of freedom such as a journal or other bearing may also be used.

Figure 14:
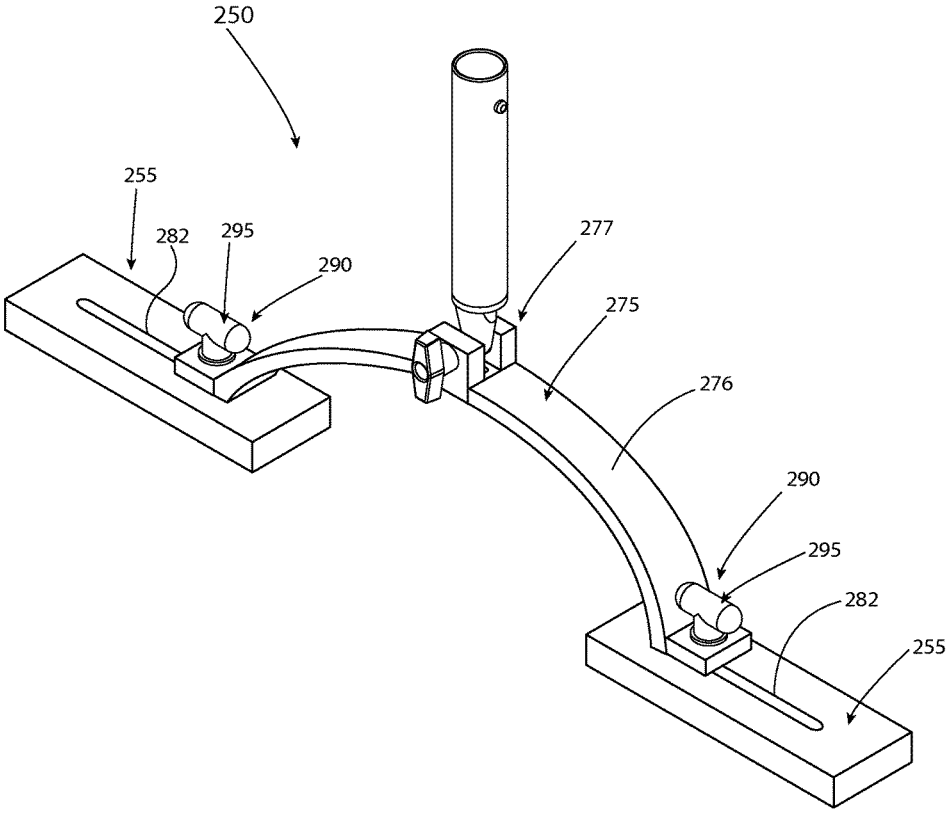
FIG. 14 is a perspective view of another alternative embodiment.

FIG. 14 shows another embodiment of a tail assembly, generally indicated by the number 250. Again like numbers are used to refer to like structures and components from each embodiment may be interchanged. In this embodiment, ends 255 may have a low profile. By low profile the axial extension of ends 255 is less than the width thereof. To space the ends 255 axially outward from the end 32 of extension 30, a slider block 275 having a profile that spaces the ends 255 outward is provided. In the example shown, slider block 275 has an arched configuration. In particular, slider block 275 includes bowed arms formed integrally therewith. Ends 255 are attached to tabs formed at each extremity of arms. Tabs extend laterally outward in a common plane.

As a further option, to adjust the position of ends 255, ends 256 are elongate and define a slot 282 therein. A fastener 290 is held by slider block 275 and extends into slot 282. The end of fastener 290 is slidable within slot 282 to allow the position of end 255 to move along slot 282 with the position of fastener 290 fixed by slider block 275. Each end is shown having the same slot 282 and fastener combination, but it will be understood that the attachment of each end 255 may be accomplished with different fasteners. Indeed, one end may be held fixed such that adjustment of the gap 270 is created by moving one of the ends 255. As in previous embodiments, to facilitate adjustment, a handle assembly 295 may be provided to selectively loosen and tighten locking assembly 290 to allow free movement of ends 255 relative to slider block and to fix the ends 255 in a selected position.

Slider block 275 may include an arched member 276 supported on an end of extension 30 as described in previous embodiments. For example, as shown, member 276 may include a clevis 277 to pivotally attach slider block 275 to an extension mount. As in earlier embodiments, attachment of clevis 277 to extension mount may include a tongue that extends from mount into clevis 277 and a fastener that passes through both the clevis 277 and tongue. This fastener may include a handle to facilitate application of a clamping force through fastener to fix the position of slider block 275 relative to receiver and in turn extension 30. It will be understood that the attachment shown is not limiting as a fixed position attachment, such as a weld or integral extension receiver is suitable. Or attachments providing greater degrees of freedom such as a journal or other bearing may also be used.

With reference to FIGS. 16-24, another alternative embodiment is shown. Like numbers will be used to describe like components in this embodiment. Also, portions of the embodiment may be incorporated into the previously described embodiments and vice versa. The embodiment generally relates to a carpet stretcher including a tail assembly 350. In this embodiment, a linkage assembly, generally indicated by the number 400 is incorporated between extension 330 and slider block 375. In the example shown, a mount 340 is provided on an end of extension 330 to attach tail assembly 350 and linkage 400 thereto. Linkage assembly 400 generally includes a first end 401 that attaches to slider block 375 and a second end 402 that attaches to extension 330. Linkage assembly 400 is movable to vary or adjust the distance $d_e$ (FIG. 18) between extension 330 and slider block 375. In the example shown, the distance is measured from the extension pivot axis E and slider block 375 to correspond to the attachment points of first end 401 and second end 402 of linkage assembly 400. It will be understood that these ends may attach to other structures in the tail assembly, swivel mount or extension to the same effect. It will be understood that varying the distance $d_e$ through linkage assembly 400 allows the user to extend or reduce the effective length of the carpet stretcher without having to exchange tail assemblies or change extension poles etc. Linkage assembly 400 may include one or more links of any size, shape or configuration. It will be understood that the number of links may vary and the method of attaching the links to the extension 330 or slider block 375 may vary without departing from the invention. Moreover, linkage assembly 400 may be used for other purposes including movement of slider block 375 relative to walls or other structures as required by the user. The movement to vary the effective length of carpet stretcher provided herein is just one example of the linkage assembly's use. As in the previous embodiments, ends 355 may extend axially outward from slider block 375 to define a gap therebetween to accommodate structures within the room such as vents, cold air returns etc.

In the example shown, linkage assembly 400 includes a first link 411 and a second link 412. Each link has a first link end 411A, 412A and a second link end 411B, 412B. The first link ends 411A, 412A are pivotally attached to slider block 375. Pivotal attachment may be made in any known manner including pins or fasteners 414 as shown. While the slider block shown in other embodiments may be used, to make the linkage assembly more compact, a slider block 375 having a thin axially inward extending portion is provided to attach the linkage assembly 400 at the first end 401 thereof. Tabs or other thin structures may extend inward from slider block 375 for this purpose or, as shown, slider block 375 may include a center rib 377 that extends inward (toward extension 330) from a base member 376 of slider block 375. In the example shown, base 376 and rib 377 are perpendicular to each other. A clearance 378, best shown in FIG. 20, is formed on either side of rib 377 adjacent to base 376 to allow the links 411,412 to attach to slider block 375 and pivot about pins 414.

Figure 24:
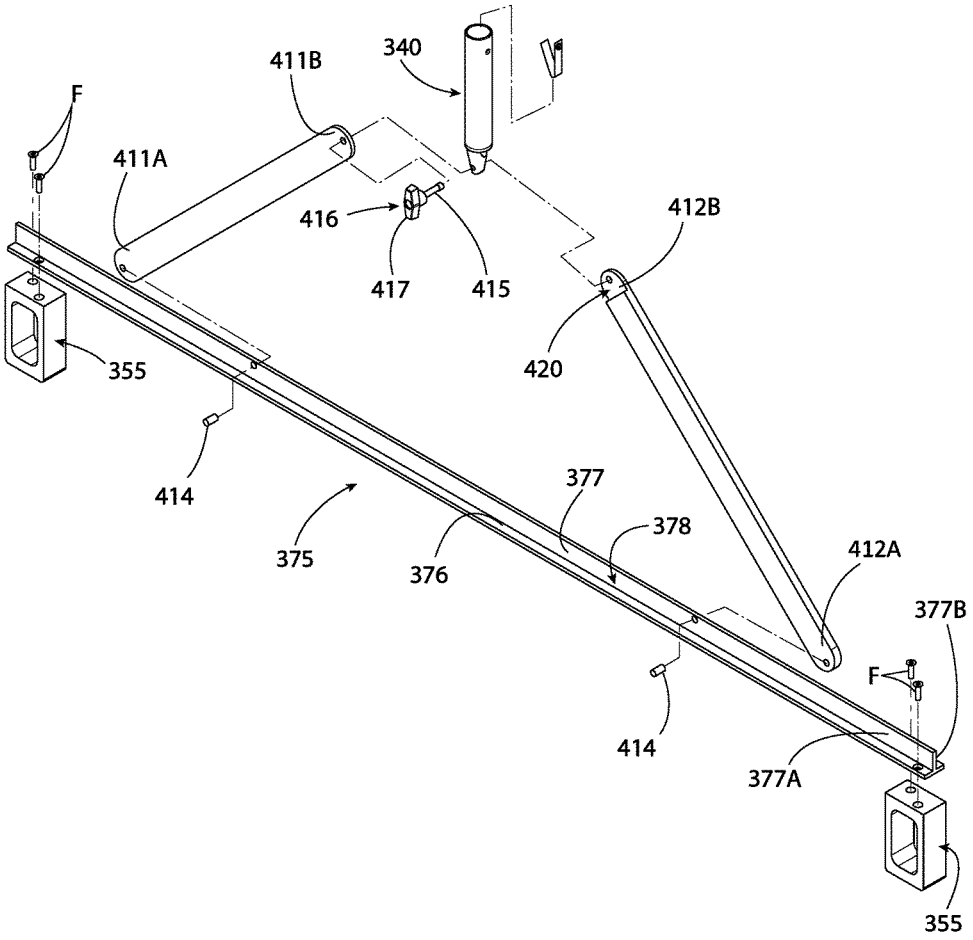
FIG. 24 is an exploded view thereof.

The second ends 411B,412B pivot about and are aligned on a common axis referred to as extension axis E. As best shown in FIG. 24, extension axis may be defined by a shaft 415 that extends through each link 411,412. In the example shown, shaft 415 is provided on a fastener, generally indicated at 416, that extends through an end of swivel mount 340. The extension axis E corresponds to the swivel axis in this embodiment. Fastener 416 may be used to clamp or otherwise fix the position of links 411 and 412 by selectively tightening the handle portion 417 of fastener 416.

The first link ends 411A,412A may extend laterally outward relative to extension axis E before attaching to slider block 375. The lateral extension of each link may be unequal or, as shown, each link may extend laterally outward an equal distance $d_L$. The lateral distance may vary depending on the desired range of motion for linkage assembly 400. In the example shown, links 411,412 attach to slider block 375 inward of ends 355. This facilitates interchanging of ends 355 by providing easier access to the fasteners F that attach ends 355 to slider block 375. With the modified slider block 375 shown in this embodiment, fasteners F are not aligned along an axis that extends parallel to the axis of the slider block as shown in earlier embodiments to accommodate the central rib 377. In the embodiment shown, fasteners F are oriented along an oblique axis relative to slider block 375. In particular, one fastener F is on one side 377A of rib 377 and the other fastener F is on a second side 377B of rib 377 while being laterally spaced from each other. The use of two fasteners in this arrangement helps prevent the ends from twisting relative to slider block 375. While holes are provided in the base 376 of slider block 375 in the embodiment shown, to provide a fixed gap 370, slots may be formed in base 376 as discussed in earlier embodiments, to adjust the position of ends 355 on slider block 375 and vary the size or offset of gap 370.

Figure 20:
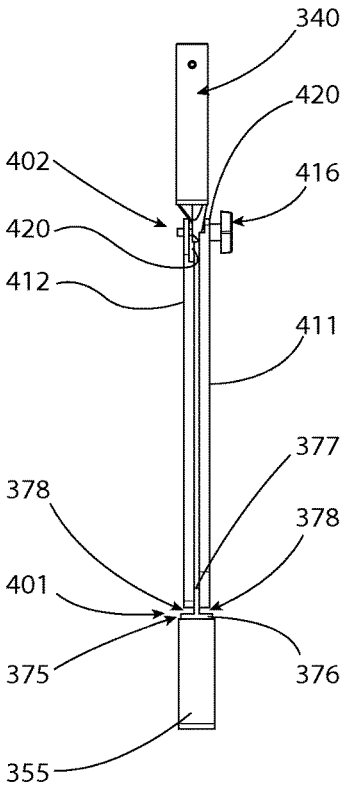
FIG. 20 is a left end view thereof.
Figure 21:
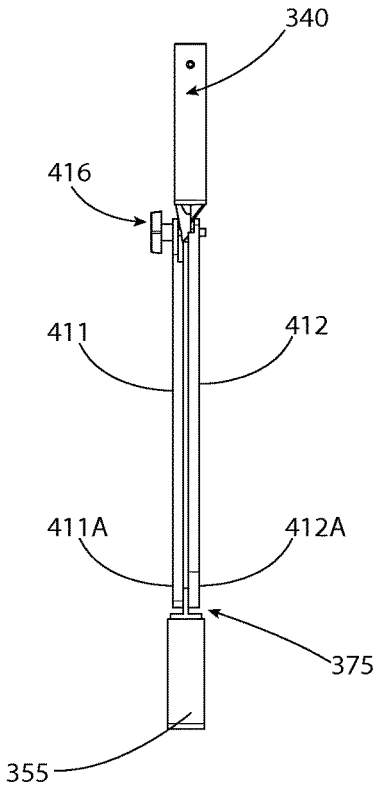
FIG. 21 is a right end view thereof.
Figure 22:
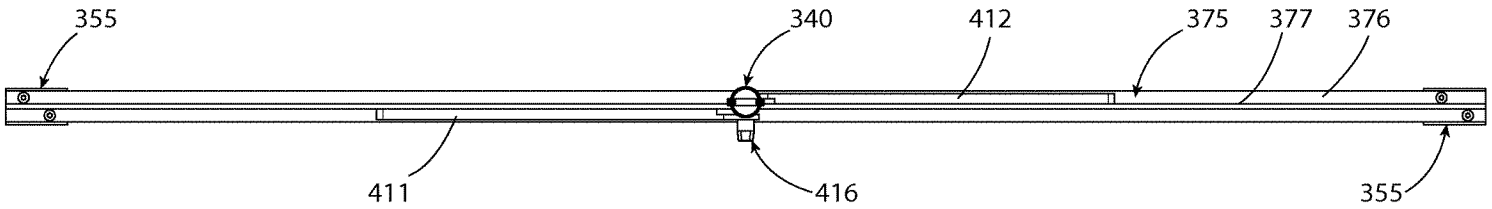
FIG. 22 is a top view thereof.
Figure 23:
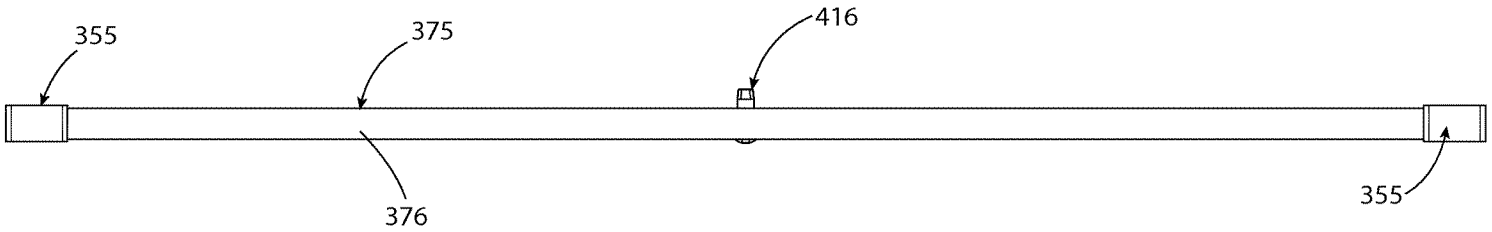
FIG. 23 is a bottom view thereof.

As best shown in FIGS. 20 and 21, swivel mount 340 may be recessed more on one side than the other at the point where links 411,412 attach. To that end, one or more of the link ends 411B,412B may be machined to facilitate attachment and proper motion of the link. In the example shown, each of the links is provided with a recess 420 at the second link end 411B,412B.

With reference to FIGS. 11 and 12, operation of a carpet stretcher having a tail assembly according to the invention will be described. Tail assemblies 50,150,250,350 each define a gap 70,170,270,370 to allow tail assembly to bear against a suitable structure S during operation of carpet stretcher. As best shown in FIGS. 11 and 12, the gap is used to accommodate structures that are not suitable for bearing a force such as a vent V, decorative object or the like. As shown, ends 55,155,255,355 are positioned to avoid bearing against an unsuitable structure V and apply force to a suitable structure S. For example, a vent V may be received between ends 55 (FIGS. 11 and 12). With the ends 55 of tail assembly positioned against a suitable structure S, tail assembly 50 is operatively connected to head assembly 20 by extension 30. Head assembly includes a pivoting handle and linkage assembly to create the force needed to stretch the free end of carpet C. In particular, downward movement of handle applies an inward force through linkage on extension 30 that is transmitted to structure S. With the immovable structure S receiving this force, an outward force is applied to head 22 causing it to move axially outward from extension 30. A telescoping rod or tube may be provided to stabilize the head 22 while allowing it to move axially outward. The free end of carpet C, which is grasped by teeth, rubber pads or other suitable means on head 22, moves axially outward i.e. is stretched by movement of head 22. Stretching of the carpet C is used to remove wrinkles from the carpet C and provide a neat and uniform finish. After or as part of the stretching movement, the free end of carpet C is attached to a tack strip T to hold the stretched and wrinkle free form. Additional trimming and other steps may be taken after the carpet is stretched as is known in the art.

While principles and modes of operation have been explained and illustrated with regard to particular embodiments, it must be understood that this may be practiced otherwise than as specifically explained and illustrated without departing from its spirit or scope. What has been described above includes examples of the subject innovation. It is, of course, not possible to describe every conceivable combination of components or methodologies for purposes of describing the claimed subject matter, but one of ordinary skill in the art may recognize that many further combinations and permutations of the subject innovation are possible. Accordingly, the claimed subject matter is intended to embrace all such alterations, modifications, and variations that fall within the spirit and scope of the appended claims.

Specific embodiments of an innovation are disclosed herein. One of ordinary skill in the art will readily recognize that the innovation may have other applications in other environments. In fact, many embodiments and implementations are possible. The following claims are in no way intended to limit the scope of the subject innovation to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means".

Although the subject innovation has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (e.g., enclosures, sides, components, assemblies, etc.), the terms (including a reference to a "means") used to describe such elements are intended to correspond, unless otherwise indicated, to any element which performs the specified function of the described element (e.g., that is functionally equivalent), even though not structurally equivalent to the disclosed structure which performs the function in the herein illustrated exemplary embodiment or embodiments of the innovation. In addition, while a particular feature of the innovation may have been described above with respect to only one or more of several illustrated embodiments, such feature may be combined with one or more other features of the other embodiments, as may be desired and advantageous for any given or particular application. Although certain embodiments have been shown and described, it is understood that equivalents and modifications falling within the scope of the appended claims will occur to others who are skilled in the art upon the reading and understanding of this specification.

In addition, while a particular feature of the subject innovation may have been disclosed with respect to only one of several implementations, such feature may be combined with one or more other features of the other implementations as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements.

What is claimed is:

1. A tail assembly in a carpet stretcher, the tail assembly including a slider block extending along a major axis of the tail assembly, a first end and a second end slidably attached to the slider block where the first end includes a first end standoff and the second end includes a second end standoff such that the first end standoff includes a first outer surface and the second end standoff includes a second outer surface and the first and second outer surfaces are each offset from the major axis of the tail assembly and where an adjustable gap, having a selected width, extending from the first end to the second end and parallel to the major axis, is adjusted by sliding at least one of the first end and the second end relative the slider block in a direction parallel to the major axis of the tail assembly;

the tail assembly also including a clevis for connecting the tail assembly to a head assembly of a carpet stretcher, the clevis attached to the slider block opposite the first outer surface and the second outer surface, relative the major axis, and a gap center extending through the clevis where the gap center is adjustable in the direction parallel to the major axis, relative the selected width, by sliding at least one of the first end and the second end relative the slider block in the direction parallel to the major axis of the tail assembly; and the tail assembly further comprising a linkage assembly having a first link and a second link where a first link end of the first link and a first link end of the second link are each pivotally attached to the slider block and a second link end of the first link and a second link end of the second link are aligned at an extension pivot axis forming the clevis and wherein the linkage assembly is moveable to vary a distance between the slider block and the second end of the linkage assembly.

2. The tail assembly of claim 1, wherein the first link ends of each of the first link and the second link are spaced laterally outward relative to the extension pivot axis by an equal amount.

3. A tail assembly in a carpet stretcher, the tail assembly including a slider block extending along a major axis of the tail assembly, a first end and a second end slidably attached to the slider block where the first end includes a first end standoff and the second end includes a second end standoff such that the first end standoff includes a first outer surface and the second end standoff includes a second outer surface and the first and second outer surfaces are each offset from the major axis of the tail assembly and where an adjustable gap, having a selected width, extending from the first end to the second end and parallel to the major axis, is adjusted by sliding at least one of the first end and the second end relative the slider block in a direction parallel to the major axis of the tail assembly;

the tail assembly also including a clevis for connecting the tail assembly to a head assembly of a carpet stretcher, the clevis attached to the slider block opposite the first outer surface and the second outer surface, relative the major axis, and a gap center extending through the clevis where the gap center is adjustable in the direction parallel to the major axis, relative the selected width, by sliding at least one of the first end and the second end relative the slider block in the direction parallel to the major axis of the tail assembly; and wherein the slider block defines a first slot and a second slot wherein the first slot and the second slot extend radially outward from a center of the slider block and a first arm and a second arm attached to the respective first end and the second end wherein a locking assembly includes a first fastener extending through the first slot and into the first arm and a second fastener extending through the second slot and into the second arm to attach the first end and the second end to the slider block, respectively, wherein the first arm and the second arm are slidably supported on the slider block by the first and second fasteners and wherein the first and second fasteners each include a pair of threaded fasteners spaced from each other and extending through said slot into threaded receivers formed in the first and second arms, each threaded fastener having a handle portion engageable with a surface of the slider block adjacent to the slot to apply a clamping force thereto.

4. The tail assembly of claim 3, wherein the locking assembly extends through the slider block and is engagable with the at least one of the first end and second end to fix the at least one of the first end and the second end with the slider block and fix the selected width between the first end and the second end.

5. The tail assembly of claim 3, where each of the first arm and the second arm extend axially outward and radially outward from the slider block, wherein the first and second ends are respectively supported on the first arm and second arm.

6. The tail assembly of claim 3, wherein the clevis has an opening corresponding to an opening in a tongue of a swivel mount where a bolt may pass through the opening of the clevis and the opening of the tongue and defines a swivel axis of rotation perpendicular to the major axis.

7. The tail assembly of claim 3 further including an extension attached to the slider block and the head assembly mounted on an opposite axial end of the extension relative to the slider block, the head assembly including a carpet engaging surface and an activation lever adapted to move the head assembly away from the tail assembly.

8. The tail assembly of claim 3, wherein each of the first end and second end extend axially outward relative the major axis, whereby the gap between the ends has a length extending from the major axis to the first and second outer surfaces.

9. The tail assembly of claim 3, wherein each end includes a pad attached thereto.

10. A tail assembly in a carpet stretcher, the tail assembly including a slider block extending along a major axis of the tail assembly, a first end and a second end slidably attached to the slider block where the first end includes a first end standoff and the second end includes a second end standoff such that the first end standoff includes a first outer surface and the second end standoff includes a second outer surface and the first and second outer surfaces are each offset from the major axis of the tail assembly and where an adjustable gap, having a selected width, extending from the first end to the second end and parallel to the major axis, is adjusted by sliding at least one of the first end and the second end relative the slider block in a direction parallel to the major axis of the tail assembly;

the tail assembly also including a clevis for connecting the tail assembly to a head assembly of a carpet stretcher, the clevis attached to the slider block opposite the first outer surface and the second outer surface, relative the major axis, and a gap extending through the clevis where the gap center is adjustable in the direction parallel to the major axis, relative the selected width, by sliding at least one of the first end and the second end relative the slider block in the direction parallel to the major axis of the tail assembly;

wherein the slider block defines a first slot and a second slot wherein the first slot and second slot extend radially outward from a center of the slider block and a first arm and a second arm attached to the respective first end and second end wherein a locking assembly includes a first fastener extending through the first slot and into the first arm and a second fastener extending through the second slot and into the second arm to attach the first end and the second end to the slider block, respectively, wherein the first arm and the second arm are slidably supported on the slider block by the first and second fasteners; and wherein the slider block further defines a channel that opens axially outward, the first slot and the second slot opening into the channel, wherein the first arm and the second arm each include a tongue portion slidably received in the channel, and wherein the tongue portion defines at least one receiver adapted to receive a portion of the fastener.

11. The tail assembly of claim 10 wherein the each of the first arm and second arm include a base portion that extends laterally outward of the tongue portion axially outward of the channel, wherein an axially inward facing surface of the base portion is slideable along an axially outward facing surface of the slider block.

12. The tail assembly of claim 11, wherein the base portion extends laterally outward from each side of the tongue portion to form a pair of shoulders adjacent to and axially outward of the tongue portion.

13. A carpet stretcher including a head assembly having a carpet engaging surface, a mounting assembly attached to the head assembly, the mounting assembly includes a handle assembly and an extension mount; a linkage attached to the handle assembly, the handle assembly including a handle that pivots on the head assembly; an extension member, the extension member having a first end and a second end, where the first end is attached to the head assembly at the extension mount;

a tail assembly attached to the extension member opposite the head assembly, the tail assembly including a slider block extending along a major axis of the tail assembly, a first end and a second end of the tail assembly slideably attached to the slider block where the first end of the tail assembly includes a first end standoff and the second end of the tail assembly includes a second end standoff such that the first end standoff includes a first outer surface and the second end standoff includes a second outer surface and the first and second outer surfaces are each offset form the major axis of the tail assembly and where an adjustable gap, having a selected width extending from the first end to the second end of the tail assembly and parallel to the major axis, is adjusted by sliding at least one of the first end and the second end of the tail assembly relative the slider block in a direction parallel to the major axis of the tail assembly, the tail assembly also including a clevis attached to the slider block opposite the first outer surface and the second outer surface, relative the major axis, and a gap center extending through the clevis where the gap center is adjustable in the direction parallel to the major axis, relative the selected width, by sliding at least one of the first end and the second end of the tail assembly relative the slider block in the direction parallel to the major axis of the tail assembly, wherein the clevis is pivotably attached to the extension member at the second end of the extension member, wherein the first end of the tail assembly is offset a different distance from the clevis in the direction parallel to the major axis than the second end of the tail assembly is offset from the clevis in the direction parallel to the major axis to offset the gap center on the slider block, relative the selected width, wherein a locking assembly includes a first slide lock supported on the slider block and selectively engaged with the first end of the tail assembly and a second slide lock supported on the slider block and selectively engaged with the second end of the tail assembly, and wherein the first slide lock and the second slide lock each include a pair of threaded fasteners extending through a portion of the slider block into a respective first and second threaded receivers formed in the respective first and second ends of the tail assembly.

14. The carpet stretcher of claim 13 wherein each threaded fastener includes a handle portion axially inward of the slider block.

15. The carpet stretcher of claim 13 further comprising a pad attached to each of the ends of the tail assembly.

16. A carpet stretcher including a head assembly having a carpet engaging surface, a mounting assembly attached to the head assembly, the mounting assembly includes a handle assembly and an extension mount; a linkage attached to the handle assembly, the handle assembly including a handle that pivots on the head assembly; an extension member, the extension member having a first end and a second end, where the first end is attached to the head assembly at the extension mount;

a tail assembly attached to the extension member opposite the head assembly, the tail assembly including a slider block extending along a major axis of the tail assembly, a first end and a second end of the tail assembly slideably attached to the slider block where the first end of the tail assembly includes a first end standoff and the second end of the tail assembly includes a second end standoff such that the first end standoff includes a first outer surface and the second end standoff includes a second outer surface and the first and second outer surfaces are each offset form the major axis of the tail assembly and where an adjustable gap, having a selected width extending from the first end to the second end of the tail assembly and parallel to the major axis, is adjusted by sliding at least one of the first end and the second end of the tail assembly relative the slider block in a direction parallel to the major axis of the tail assembly, the tail assembly also including a clevis attached to the slider block opposite the first outer surface and the second outer surface, relative the major axis, and a gap center extending through the clevis where the gap center is adjustable in the direction parallel to the major axis, relative the selected width, by sliding at least one of the first end and the second end of the tail assembly relative the slider block in the direction parallel to the major axis of the tail assembly and wherein the clevis is pivotably attached to the extension member at the second end of the extension member, and the carpet stretcher further comprising a linkage assembly having a first link and a second link where a first link end of the first link and a first link end of the second link are each pivotally attached to the slider block and a second link end of the first link and a second link end of the second link are aligned at an extension pivot axis forming the clevis and wherein the linkage assembly is moveable to vary a distance between the slider block and the extension.

17. The carpet stretcher of claim 16, where the second link ends of each of the first link and second link being pivotable about the extension pivot axis, wherein the first link ends of each of the first link and the second link are spaced laterally outward relative to the extension axis by an equal amount.

* * * * *